United States Patent [19]

Moser

[11] Patent Number: 4,967,855

[45] Date of Patent: Nov. 6, 1990

[54] DRILLING TOOL

[75] Inventor: Bernhard Moser, Ulrichstrasse, Fed. Rep. of Germany

[73] Assignee: Hawera Probst GmbH & Co., Fed. Rep. of Germany

[21] Appl. No.: 411,819

[22] Filed: Sep. 25, 1989

[30] Foreign Application Priority Data

Oct. 12, 1988 [DE] Fed. Rep. of Germany ..... 3834675

[51] Int. Cl.[5] ..... E21B 10/44; B27G 15/00

[52] U.S. Cl. ..... 175/394; 175/323; 144/221; 408/230

[58] Field of Search ..... 175/310, 323, 394, 395, 175/102; 299/87; 408/230; 52/157; 198/676; 144/221

[56] References Cited

U.S. PATENT DOCUMENTS

| | | | |
|---|---|---|---|
| 455,824 | 7/1891 | Wyman | 175/394 |
| 2,084,737 | 6/1937 | Magnus | 408/230 |
| 2,876,995 | 3/1959 | Neighly | 175/395 |
| 2,981,403 | 4/1961 | Goodrich | 175/323 |
| 3,749,189 | 7/1973 | Boehm | 175/394 |
| 3,773,122 | 11/1973 | Chromy | 175/394 |
| 4,210,215 | 7/1980 | Peetz et al. | 175/323 |
| 4,579,180 | 4/1986 | Peetz et al. | 175/394 |
| 4,712,948 | 12/1987 | Kidani | 408/230 |

FOREIGN PATENT DOCUMENTS

| | | | |
|---|---|---|---|
| 0126409 | 11/1984 | European Pat. Off. . | |
| 333896 | 3/1921 | Fed. Rep. of Germany . | |
| 1291707 | 11/1969 | Fed. Rep. of Germany . | |
| 2159728 | 6/1973 | Fed. Rep. of Germany | 175/394 |
| 1927754 | 12/1978 | Fed. Rep. of Germany . | |
| 2756140 | 6/1979 | Fed. Rep. of Germany . | |

*Primary Examiner*—Bruce M. Kisliuk

*Attorney, Agent, or Firm*—Spencer & Frank

[57] ABSTRACT

A drilling tool, in particular for use in axially striking drive machines for drilling in rock, concrete or the like, which drilling tool is designed from both a vibration point of view by varying the abrupt changes in cross-section and from a drilling point of view by optimising the transport of the drilling dust. In order to arrange, from a vibration point of view, the abrupt changes in cross section, caused by the flute webs, in asymmetrically arranged axial positions, the inclination of the conveying flute constantly changes its size within a lead. Furthermore, the radial, tangential and axial force vector which acts on the drilling dust constantly changes its size, the radial force vector also changing its direction. In this way, the drilling dust is subjected to a constantly changing acceleration.

12 Claims, 23 Drawing Sheets

DRILLING TOOL

BACKGROUND OF THE INVENTION

1. Field of the Invention

The invention relates to a drilling tool according and more particularly for drilling in hard substances such as rock or concrete with axially striking drive machines.

2. Discussion of the Background

EP-B1-0,126,409 has disclosed a drilling tool of the type as defined in the preamble. In this known drilling tool, the drilling-dust flute does not run at constant inclination over its entire length. On the contrary, it has its smallest inclination in the area of the drill head, while it preferably has steadily increasing inclination in the remaining area. In this way, the uniform spacings, present in drilling tools having uniform inclination, between the abrupt changes in cross-section which result at the transition of the drilling-dust flute to the helix webs are avoided. According to the findings in this prepublication, uniformly spaced abrupt changes in cross-section result in disadvantages with regard to the superimposition of vibrations, resonance phenomena and sound emission. To optimally convert the striking energy of the striking impulse and thus to convert a higher cutting energy as well as to obtain a decrease in the sound emission, the known device therefore proposes a steadily changing inclination in the conveying helix. In particular exemplary embodiments, sectional areas are also provided with uniform inclination, but they extend over a different number of leads. However, the essential point of the known device is to obtain, in the area of the drill head, a conveying helix having small inclination and thus a large lateral supporting surface as a drill guide surface. However, this inclination is to increase steadily or continuously in the direction of the drill chucking shank.

Furthermore, in the known publication, it is stated in columns 5 to 7 that the drilling-dust flutes in the area of small angles of inclination, i.e. in particular in the area of the drill head, have a virtually rectangular cross-section, the respective back face or outer circumferential face of the flute web forming virtually a 90° flank angle to the drilling-dust carrying surface. Accordingly, in the conveying-helix area having small inclination, relatively wide drilling-dust carrying surfaces for the accumulating drilling dust and thus reliable disposal flutes for the drilling dust are formed.

Furthermore, the known publication points out that the rectangular cross-sectional shape of the drilling-dust flutes is not necessary in the area of large flute inclination. As the inclination of the conveying helix increases in the direction of the chucking end of the drill, the drilling-dust carrying surface adjoining the lateral back face of the flute webs becomes narrower and narrower, the at first 90° flank angle continually increases and finally forms merely a curved connection to the respective back face. Adequate feed and transport of the drilling dust is guaranteed by the large flute cross-section (at increasing inclination) (at increasing inclination) flute cross-section of the drilling-dust flute.

In this respect, it is also pointed out in the known publication that, even in conveying-helix areas having a large inclination, the approximately rectangular cross-sectional shape of the disposal flutes could of course be retained, i.e. a rectangular cross-section over the entire length of the drilling-dust flute.

This known publication therefore shows drillingdust flutes with varying inclination, the carrying surface of the drilling-dust flute in areas of small inclination being designed as a wide carrying surface virtually at right angles to the lateral back face of the flute webs, while, as inclination increases, this carrying surface runs as a carrying surface which becomes narrower and has a gradually curved transition to the lateral back face of the flute webs. The surface normal, i.e. a perpendicular force vector on this drilling-dust carrying surface, therefore also changes in its direction when inclination changes.

Drilling-dust flutes of this type are described in German Patent Specifications No. 1,291,707 and 1,927,754. Here, the drilling-dust carrying surfaces are shown as undercut, bulbous or pocket-shaped rounded portions whose radially outer transition surface to the lateral circumferential face of the drill or back face encloses an acute flank angle which is likewise approximately 90°, and preferably 75° to 80° (see Patent Specification 1,927,754, column 4, line 37 ff.) If this specified flank angle $\beta$ is $<90°$, the undercut drilling-dust flute is designated by a "positive" flank angle. If the transition of the carrying surface to the side surface forms an angle $\beta>90°$, this is designated by a "negative" flank angle.

The change in the drilling-dust carrying surface arising in EP-No. 0,126,409 mentioned above, as a result of the changes in inclination therefore corresponds to a gradual transition of the neutral flank angle ($\beta\approx 90°$) to a negative flank angle ($\beta>90°$).

SUMMARY OF THE INVENTION

The object of the invention is to further develop a drilling tool of the type designated above, the advantages of the subject-matter of EP-No. 0,126,409 being retained but the intention being to further improve the drilling-dust conveyance and thus the drilling performance.

As indicated previously, in the subject-matter of EP-No. 0,126,409, the flank angle of the drilling-dust carrying surface changes as the inclination of the conveying helix changes, in which arrangement, the wide drilling-dust carrying surface, adjoining the axially parallel back face of the conveying helix at right angles when the conveying helix has a small inclination, gradually merges into a curved narrower carrying surface for the drilling dust as the inclination of the conveying helix increase. As a result, the flank angle, which at first is at 90° to the axially parallel back face, becomes an obtuse angle $>90°$. This angle corresponds to the angle $\beta$ in Patent Specification No. 1,927,754.

At a positive flank angle ($\beta<90°$), the surface normal or the force vector on the drilling-dust carrying surface is directed inward, i.e. toward the drill axis, as a result of which a resulting radial force component becomes directed toward the drilling dust, and toward a drill axis; conversely, at a negative flank angle this radial force component is directed outward. Accordingly, in the case of the publication EP-No. 0,126,409, when a drilling-dust carrying surface is at first arranged at right angles ($\beta=90°$), no radial merely the force vector orientated as a surface normal acts on the drilling-dust particles. Due to the increasing inclination of the flute, the flank angle $\beta$ likewise increases so that the surface normal or the perpendicular force vector on the drilling-dust carrying surface is directed outward at an increasingly oblique angle and an increasing radial force component directed outward results. However, the drillingdust conveyance with outwardly directed radial force component (negative flank angle) behaves differently from that with radially inwardly directed force component (positive flank angle), in particular with regard to an increased wall friction between drilling dust and drilled hole and a supporting effect associated therewith between drilled hole and drilling tool.

Compared with EP-No. 0,126,409, the present invention in particular provides for a change to occur between a positive and a negative flank angle $\beta$ per pitch "h" of the conveying-helix inclination and thus for a reversal in direction to occur in the radial force component, which is at first directed inward and then outward. By this measure, the drilling dust in the drilling-dust flute, i.e. on the drilling-dust carrying surface, is constantly subjected to a changing radial, tangential and axial force effect; i.e. the radial, tangential and axial force vectors on the drilling-dust particles change their direction within a pitch. Therefore provision is made according to the invention for a conveying-helix area with positive flank angle ($\beta<90°$) to be located within a lead, which positive flank angle, via a right-angled arrangement ($\beta=90°$) of the drilling-dust carrying surface, changes into a negative flank angle ($\beta>90°$) in order to then return again to the initial point ($\beta<90°$). In this way, in particular the force component which is at first directed radially inward changes to a force component directed radially outward and returns to the initial position. At the same time, the axial and tangential force component on the drilling-dust particles also changes so that a constantly changing acceleration acts on the drilling-dust particles within a lead, which on the whole leads to positive transport of drilling dust and to a considerable increase in performance.

In a particularly convenient and simple manner, the changing flank angle $\beta$ is obtained by varying the inclination of the flute within a lead "h". Compared with EP-No. 0,126,409, however, it is not a steadily increasing inclination which is selected but an inclination which changes within a lead or pitch "h", in which arrangement, within a lead, at first a small inclination changes into a larger inclination and the latter in turn runs out into a small inclination. In this way, the at first positive flank angle ($\beta$90°) changes into a negative flank angle ($\beta>90°$) in order to then become positive again. However, the change in the flank angle can in principle also be produced at a uniform inclination and in fact by special tool configurations.

Alternatively, the drilling-dust carrying surface according to the invention, e.g. over 90° or 180° angular rotation, can have carrying-surface sections which are uniform or change steadily in flank angle or inclination but always start at the drill head with a positive flank angle ($\beta<90°$) which changes into a negative flank angle ($\beta>90°$) and finally leads back again to a positive within pitch. negative flank angle ($\beta$90°) and small pitch for a positive flank angle ($\beta$90°) is advantageously $h_2:h_1\approx1.2$ to 2.5 and is preferably at a value of $h_2:h_1\approx1.6$ ($\alpha_2:\alpha_1$1.2–2.5, in particular$\approx$1.2 to 2.5in particular$\approx$1.6).

The design of the drill head with a triangular cross-section to increase the performance is also especially advantageous.

BRIEF DESCRIPTION OF THE DRAWINGS

Further details and more precise explanations follow from the exemplary embodiment described below. In the drawing.

DETAILED DESCRIPTION OF THE PREFERRED EMBODIMENTS

Figure 1:
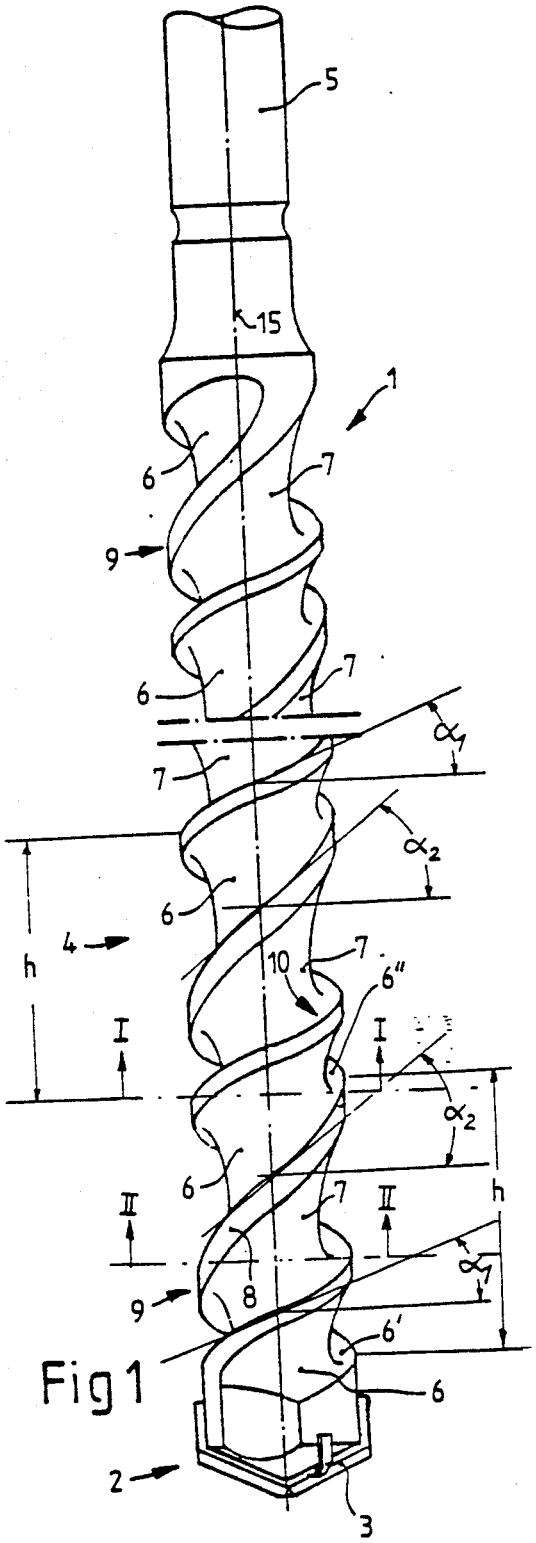
FIG. 1 shows a side view of the drilling tool according to the invention.

The drilling tool 1 shown in FIG. 1 consists of a drill head 2 with carbide cutting elements 3 and a drilling-dust conveying helix 4 adjoining the drill head and a drill shank 5 adjoining the drilling-dust conveying helix 4. In the exemplary embodiment, the conveying helix is designed as a double-start conveying helix, i.e. the conveying helix 4 is formed by two conveying flutes 6, 7 arranged offset by 180° . The conveying-helix webs 8, with their axially parallel outer back faces 9, delimit the conveying flutes 6, 7. A widening in the cross-section of the drilling tool therefore occurs in this area.

In FIG. 1, to produce drilling-dust carrying surfaces of different flank angle, the flute area having a small or slight angle of inclination is designated by $\alpha_1$ and a flute area having a large angle of inclination is designated by $\alpha_2$. It is already clearly apparent from FIG. 1 that-starting at the drill head 2-the at first small flute inclination $\alpha_1$ gradually increases up to the maximum value $\alpha_2$ and then falls back again to the flute inclination $\alpha_1$. This takes place within a lead "h" (360° rotation), i.e. the narrow conveying flute 6′ at the drill head 2 requires a lead "h" in order to reach the narrow conveying-flute area 6″ again. Preferably the ratio between inclinations $\alpha_2$ and $\alpha_1$ is 1.2 to 2.5, and most preferably 1.6.

Figure 2:
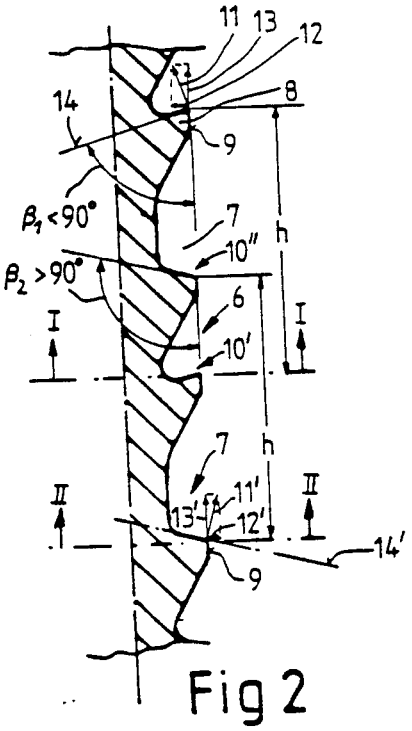
FIG. 2 shows an axial section through the conveying helix.

In the sectional representation of the helix according to FIG. 2, the shaping of the drilling-dust carrying surfaces 10 of the drilling-dust flutes 6, 7 is shown in greater detail. If the conveying helix 4 has a small angle of inclination $\alpha_1$, the associated flank angle $\beta_1$ between axially parallel back face 9 of the conveying helix webs 8 is less than 90° ($\beta_1<90°$) so that a positive flank angle is referred to. In this way, the drilling-dust carrying surface 10′ is designed with an undercut, as also shown in German Patent Specification 1,927,754. In accordance with the sectional representation I—I, this state is shown in radial section in FIG. 3.

Due to the undercut with so-called positive flank angle, the surface normal 11, i.e the force vector 11 disposed perpendicularly to the drilling-dust carrying surface 10, is slanted inward in the direction of drill axis 15, which leads to a force component or force vector 12 directed radially inward and a tangential force vector 13 as a resultant of the force vector 11. The surface tangent to the drilling-dust carrying surface is designated by reference numeral 14. In this arrangement, the drilling-dust particles are thrust into the drilling-dust flute and not radially outward.

If the drilling-dust carrying surface 10 is arranged at right angles (neutral flank angle) to the lateral back face 9, i.e. $\beta=90°$, the surface normal or the force vector 11 is parallel to the plane of symmetry 16 of the drill, i.e. there are no inwardly or outwardly directed radial forces.

Figure 4:
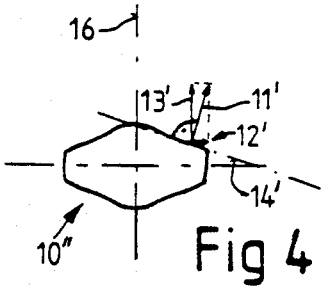
FIG. 4 shows a radial section along cutting line II—II in FIGS. 1 and 2.

If the flank angle $\beta_2$ between drilling-dust carrying surface 10 and lateral, axial back face 9 becomes greater than 90°($\beta_2>90°$) (carrying surface 10″), this corresponds to the sectional representation in FIG. 4. This state is defined as negative flank angle In this case, the surface normal 11', i.e. the force vector 11' disposed perpendicularly to the drilling-dust carrying surface 10'' or surface tangent 14', is directed outward, i.e., away from the plane of symmetry 16 of the drill, which leads to a force vector 12' directed radially outward and a tangential force vector 13'. The force vector 12' directed radially outward causes the drilling-dust particles to be accelerated outward. In addition, the friction between drilled hole and drilling tool increases.

The constant changing of the force vector 12 directed radially inward to a force vector 12' directed radially outward results in a constantly changing radial force effect on the drilling-dust particles, which leads to considerable loosening. With the change in the radial force vectors 12, 12', the size of the tangential force vector 13, 13' also changes so that here, too, a changing tangential acceleration of the drilling-dust particles occurs.

Figure 3:
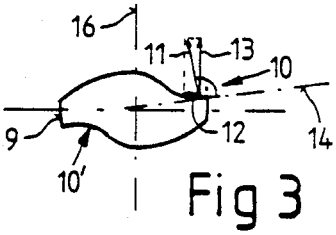
FIG. 3 shows a radial section along cutting line I—I in FIGS. 1 and 2.

In FIGS. 3 and 4, the surface tangent of the drilling-dust carrying surface 10, 10', 10'' is designated by reference numerals 14 and 14' respectively. This surface, in accordance with the representation in FIG. 2, constantly tilts rocker-like in a reciprocating manner.

Accordingly, due to the axial impact stress on the tool, the force vectors 11, 12, 13 and 11', 12', 13' respectively plotted in FIGS. 3 and 4 appear in FIG. 2 as axially, tangentially and radially acting force vectors. For the sake of simplicity, these force vectors, belonging to the different drilling-dust flutes 10' and 10'' respectively, are likewise designated in FIG. 2 by the The inclination, changing within a lead "h", is shown schematically in its development in FIG. 5. If, for example, the first drilling-dust flute 6 is considered, it starts at the drill head 2 with the shallow of inclination $\alpha_1$ (drilling-dust flute 6') and, after a rotational angle of the drilling tool of $\gamma_1 \leqq 90°$, merges into the steeper angle of inclination $\alpha_2$. This area is identified in FIG. 1 by reference numeral 6. The steeper angle of inclination $\alpha_2$, after a rotational angle of $\gamma_2 \leqq 180°$, merges again into the shallower angle of inclination $\alpha_1$, the latter, in the representation according to FIG. 5, covering a rotational angle of $\gamma_1 90°$. This area is identified in FIG. 1 by 6''. Within a lead, the angle of inclination therefore changes from $\alpha_1$ to $\alpha_2$, an overall change in the pitches taking place after each angular rotation of 180°.

Figure 5:
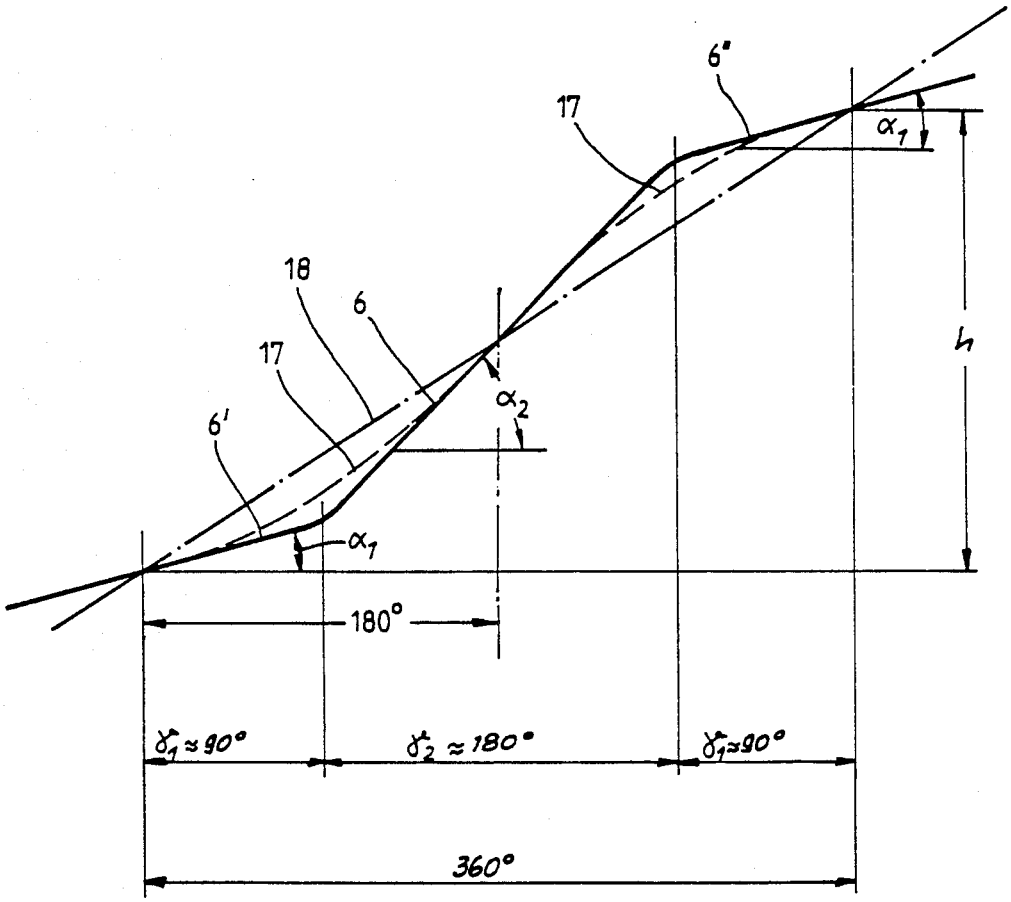
FIG. 5 shows a representation of the course of the flute inclination within a lead.

In FIG. 5, the supporting areas 6', 6, 6'', i.e. the angular areas $\gamma_1$, $\gamma_2$ are designed as inclination sections each having a uniform inclination. However, in accordance with the inclination line 17, additionally drawn in a broken line, the course of the inclination can also be gradual, i.e. the inclination can change steadily. A conventional course of the inclination uniform inclination over a lead, is shown by reference numeral 18.

The change in the flank angle $\beta$ is therefore conveniently brought about via a change in the inclination $\alpha$ of the conveying flute 6, 7. With appropriate tools, however, such a change in the angle $\beta$ and thus in the desired force vectors 11, 12, 13 can also be achieved at uniform flute inclination.

Figure 6:
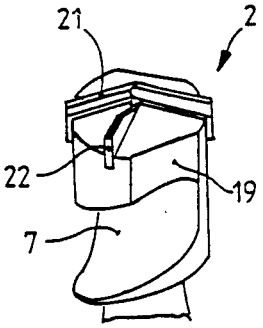
FIG. 6 shows an exemplary embodiment for the drill head.
Figure 7:
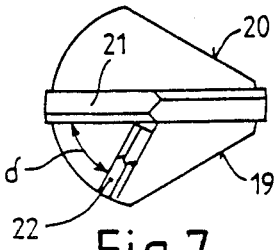
FIG. 7 shows an end elevation of FIG. 6.

A further increase in the performance of the tool is possible by combining the flute design according to the invention with a specific drill head, as shown in FIGS. 6 and 7. For this purpose, the drill head 2 is designed to be V-shaped or triangular in cross-section as shown schematically in FIGS. 6 and 7. The two side flanks 19, 20 of the drill head 2 are designed to be flat or concavely arched in order to form the transition to the drilling-dust flutes 6, 7. The one-piece main cutting tip 21 forms the angle bisector for the two side flanks 19, 20, it preferably being possible for an additional secondary cutting tip 22 to be arranged at an acute angle & to the main cutting tip 21. The secondary cutting tip 22 can likewise be designed in a roof-like shape like the main cutting tip 21. The angle $\delta$ is about 40 to 70°.

The invention is not restricted to the exemplary embodiment shown and described. On the contrary, it also includes all further developments by a person skilled in the art without separate inventive content.

I claim:

1. A drilling tool having an axis, comprising a drill head, a conveying helix adjoining the drill head and a chucking shank adjoining the conveying helix, the conveying helix having a flute web, the flute web having a face furthest from and parallel to the axis and a drilling-dust carrying surface, the drilling-dust carrying surface being disposed at a flank angle, wherein the flank angle is the angle between said face and the drilling-dust carrying surface, wherein the from a value less than 90° to a value greater than 90° and then to the initial value as viewed along said drilling-dusting carrying surface over one 360° turn about said axis.

2. The drilling tool as claimed in claim 1, wherein the conveying helix is a double-start conveying helix.

3. The drilling tool as claimed in claim 2, further comprising a flute angle $\alpha$ between a perpendicular to the axis and a tangent to the flute web at the dust-carrying surface, wherein the change in the flank angle occurs through a change in the flute angle $\alpha$ of the conveying helix, a flank angle less than 90° being allocated to a small flute angle $\alpha_1$, and a flank angle greater than 90° being allocated to a larger flute angle $\alpha_2$ of the conveying helix.

4. The drilling tool as claimed in claim 3, wherein the ratio between the flute angles $\alpha_2$ and $\alpha_1$ is 1.2 to 2.5.

5. The drilling tool of claim 4, wherein the ratio between the flute angles 60 $_2$ and $\alpha_1$ is 1.6.

6. The drilling tool as claimed in claim 3, further comprising a rotational angle of the drilling tool $\gamma$, wherein, within one 360° turn about said axis, the smaller flute angle $\alpha_1$, extends over a peripheral section of $2\gamma_1$ where $\gamma_1 = 90°$, and the larger flute angle $\alpha_2$ located in between the small flute angle peripheral section extends over a peripheral section of $\gamma_2 \times 180°$.

7. The drilling tool as claimed in claim 6, wherein the flute angle $\alpha_1$, $\alpha_2$ of the conveying helix is constant over each of the peripheral sections $\gamma_1$, $\gamma_2$.

8. The drilling tool as claimed in claim 6, wherein the flute angle $\alpha_1$, $\alpha_2$ of the conveying helix changes steadily over each of the peripheral sections $\gamma_1$, $\gamma_2$.

9. The drilling tool as claimed in claim 2, further comprising a flute angle 60 between a perpendicular to the axis and a tangent to the flute web at the dust-carrying surface, wherein the flute angle $\alpha$ of the conveying helix of each drilling-dust flute changes from a minimum value $\alpha_1$, to a maximum value $\alpha_2$ and then back to the minimum value $\alpha_1$ over one 360° turn about the axis.

10. The drilling tool as claimed in claim 1, wherein the drill head is designed to be V-shaped or triangular in cross section, having two flat or concavely arched side flanks as a transition to the drilling-dust flutes the one-piece main cutting tip forming the angle bisector for the two side flanks, and preferably at least one secondary cutting tip being provided at an acute angle to the main cutting tip.

11. The drilling tool of claim 1, wherein the flank angle changes continuously over one 360° turn about said axis.

12. The drilling tool of claim 1, wherein the flank angle changes intermittently over one 360° turn about said axis.

* * * * *

UNITED STATES PATENT AND TRADEMARK OFFICE

CERTIFICATE OF CORRECTION

PATENT NO. : 4,967,855

DATED : November 6th, 1990

INVENTOR(S) : Bernhard Moser

It is certified that error appears in the above-identified patent and that said Letters Patent is hereby corrected as shown below:

On the title page at bottom of column 2, change "23 Drawing Sheets" to --3 Drawing Sheets--.

Signed and Sealed this

Seventh Day of April, 1992

*Attest:*

HARRY F. MANBECK, JR.

*Attesting Officer*

*Commissioner of Patents and Trademarks*